US009133717B2

(12) United States Patent
Nakamata et al.

(10) Patent No.: US 9,133,717 B2
(45) Date of Patent: Sep. 15, 2015

(54) COOLING STRUCTURE OF TURBINE AIRFOIL

(75) Inventors: Chiyuki Nakamata, Tokyo (JP); Takashi Yamane, Chofu (JP); Yoshitaka Fukuyama, Chofu (JP); Takahiro Bamba, Chofu (JP)

(73) Assignees: IHI Corporation, Tokyo (JP); Japan Aerospace Exploration Agency, Tokyo (JP)

( * ) Notice: Subject to any disclaimer, the term of this patent is extended or adjusted under 35 U.S.C. 154(b) by 1151 days.

(21) Appl. No.: 12/812,227

(22) PCT Filed: Jan. 8, 2009

(86) PCT No.: PCT/JP2009/050113
§ 371 (c)(1),
(2), (4) Date: Oct. 5, 2010

(87) PCT Pub. No.: WO2009/088031
PCT Pub. Date: Jul. 16, 2009

(65) Prior Publication Data

US 2011/0027102 A1 Feb. 3, 2011

(30) Foreign Application Priority Data

Jan. 8, 2008 (JP) ..... 2008-000912

(51) Int. Cl.
*F01D 5/18* (2006.01)

(52) U.S. Cl.
CPC ..... *F01D 5/189* (2013.01); *F01D 5/186* (2013.01); *F05D 2240/121* (2013.01);
(Continued)

(58) Field of Classification Search
CPC ... F01D 5/182; F01D 5/189; F05D 2260/201; F05D 2260/202
USPC ..... 415/115, 116, 175, 178; 416/90 R, 92, 416/97 R, 224, 231 R
See application file for complete search history.

(56) References Cited

U.S. PATENT DOCUMENTS 3,628,880 A * 12/1971 Smuland et al. ..... 415/175
3,806,276 A * 4/1974 Aspinwall ..... 416/97 R
(Continued)

FOREIGN PATENT DOCUMENTS

EP 0 416 542 A1 3/1991
EP 0 798 448 A2 10/1997
(Continued)

OTHER PUBLICATIONS

International Search Report issued in corresponding Japanese application PCT/JP2009/050113, completed Jan. 23, 2009, mailed Feb. 3, 2009.
(Continued)

*Primary Examiner* — Sean J Younger
(74) *Attorney, Agent, or Firm* — Griffin & Szipl, P.C.

(57) ABSTRACT

A cooling structure of a turbine airfoil cools a turbine airfoil (10) exposed to hot gas (1), using cooling air (2) of a temperature lower than that of the hot gas. The turbine airfoil (10) includes an external surface (11), an internal surface (12) opposite to the external surface, a plurality of film-cooling holes (13) blowing the cooling air from the internal surface toward the external surface to film-cool the external surface, and a plurality of heat-transfer promoting projections (14) integrally formed with the internal surface and protruding inwardly from the internal surface. The turbine airfoil further includes a hollow cylindrical insert (20) which is positioned inside the internal surface of the turbine airfoil and to which the cooling air is supplied. The insert has a plurality of impingement holes (21) for impingement-cooling the internal surface (12).

5 Claims, 6 Drawing Sheets

(52) U.S. Cl.
CPC .... *F05D 2240/122* (2013.01); *F05D 2240/303* (2013.01); *F05D 2240/304* (2013.01); *F05D 2260/201* (2013.01); *F05D 2260/205* (2013.01); *F05D 2260/2212* (2013.01); *F05D 2260/2214* (2013.01); *F05D 2260/22141* (2013.01)

(56) References Cited

U.S. PATENT DOCUMENTS

| | | | | | |
|---|---|---|---|---|---|
| 3,891,348 | A | * | 6/1975 | Auxier | 416/97 R |
| 4,118,146 | A | * | 10/1978 | Dierberger | 416/97 A |
| 4,183,716 | A | * | 1/1980 | Takahara et al. | 416/96 A |
| 4,403,917 | A | * | 9/1983 | Laffitte et al. | 416/96 A |
| 4,695,247 | A | * | 9/1987 | Enzaki et al. | 431/352 |
| 5,100,293 | A | | 3/1992 | Anzai et al. | |
| 5,328,331 | A | * | 7/1994 | Bunker et al. | 416/96 R |
| 5,352,091 | A | | 10/1994 | Sylvestro | |
| 5,516,260 | A | * | 5/1996 | Damlis et al. | 415/115 |
| 5,533,864 | A | * | 7/1996 | Nomoto et al. | 416/96 A |
| 5,586,866 | A | * | 12/1996 | Wettstein | 416/96 A |
| 5,624,231 | A | * | 4/1997 | Ohtomo et al. | 416/97 R |
| 5,779,438 | A | | 7/1998 | Wilfert | |
| 6,142,734 | A | * | 11/2000 | Lee | 416/97 R |
| 6,174,134 | B1 | | 1/2001 | Lee et al. | |
| 6,238,182 | B1 | * | 5/2001 | Mayer | 416/96 A |
| 6,318,963 | B1 | * | 11/2001 | Emery et al. | 416/96 A |
| 6,439,846 | B1 | * | 8/2002 | Anderson et al. | 416/96 R |
| 6,582,186 | B2 | * | 6/2003 | Manzoori et al. | 416/96 A |
| 6,582,194 | B1 | * | 6/2003 | Birkner et al. | 416/97 R |
| 7,300,251 | B2 | * | 11/2007 | Kitamura et al. | 416/97 R |
| 2006/0210399 | A1 | | 9/2006 | Kitamura et al. | |

FOREIGN PATENT DOCUMENTS

| | | | |
|---|---|---|---|
| EP | 1 043 479 | A2 | 10/2000 |
| JP | 59 079009 | A | 5/1984 |
| JP | 61-63401 | | 4/1986 |
| JP | 61-187501 | | 8/1986 |
| JP | 9-507549 | | 7/1997 |
| JP | 2002-174102 | A | 6/2002 |

OTHER PUBLICATIONS

Office Action issued on Feb. 23, 2012 and dated Feb. 27, 2012 in the priority Japanese Patent Application No. 2008-000912.

European Search Report issued in corresponding application No. 09700222.4 completed Feb. 4, 2011 and mailed Feb. 14, 2011.

* cited by examiner

COOLING STRUCTURE OF TURBINE AIRFOIL

This is a National Phase Application in the United States of International Patent Application No. PCT/JP2009/050113 filed Jan. 8, 2009, which claims priority on Japanese Patent Application No. 2008-000912, filed Jan. 8, 2008. The entire disclosures of the above patent applications are hereby incorporated by reference.

BACKGROUND OF THE INVENTION

1. Technical Field of the Invention

The present invention relates to a cooling structure of a turbine airfoil in a gas turbine for aviation or industry.

2. Description of the Prior Art

In the turbine airfoil of a gas turbine for aviation or industry, since the external surface is exposed to hot gas (e.g., 1000° C. or more) during operation, the turbine airfoil is generally cooled from the inside thereof by flowing cooling gas (e.g., cooling air) into the inside so as to prevent the turbine airfoil from overheating.

In order to improve the cooling performance of the turbine airfoil, several proposals have been suggested (e.g., Patent Documents 1 to 3).

In the gas turbine airfoil disclosed in Patent Document 1, the cooling air is fed from a tube 56 inside an airfoil 50, as shown in FIGS. 1A, 1B and 1C. The cooling air 69 flows toward the internal surface 54 of the airfoil through flow openings 68 of the tube 56. Small, elongated protrusions 61 are installed on at least the same positions as the flow openings 68 of the airfoil internal surface 54. The passage area of a flow passage 58 between the tube 56 and the airfoil internal surface 54 is increased toward an outlet 60 side.

The gas turbine airfoil disclosed in Patent Document 2 includes a first sidewall 70 and a second sidewall 72 which are connected to each other by a leading edge 74 and a trailing edge 76, and a first cavity 77 and a second cavity 78 which are spaced to be separated by a partition wall positioned between the first side wall 70 and the second side wall 72, as shown in FIGS. 2A and 2B. A rearward bridge 80 extends along the first cavity 77, and has a row of outlet holes 84 therein. The partition wall 88 has a row of inlet holes 82. A row of turbulators 86 are arranged on the inside of the first cavity 77, and extend from the first sidewall to the second sidewall. The turbulators 86 are inclined with respect to the inlet holes 82 to perform multiple impingement cooling.

The gas turbine airfoil disclosed in Patent Document 3 includes an external surface 91 facing combustion gas 90 and an internal surface 92 against which cooling gas impinges, as shown in FIG. 3. The internal surface 92 is provided with a plurality of ridges 94 and a plurality of grooves 96 so as to improve heat transfer due to impingement cooling.

Patent Document 1: U.S. Pat. No. 5,352,091 entitled "GAS TURBINE AIRFOIL"

Patent Document 2: U.S. Pat. No. 6,174,134 entitled "MULTIPLE IMPINGEMENT AIRFOIL COOLING"

Patent Document 3: U.S. Pat. No. 6,142,734 entitled "INTERNALLY GROOVED TURBINE WALL"

In general, since the airfoil leading edge of the gas turbine has a large curvature, the cooling side area which comes into contact with the cooling gas is small as compared with the hot side area which is exposed to the high-temperature gas. For this reason, there are many cases where the airfoil leading edge does not obtain the necessary cooling effectiveness only by convection cooling at the cooling sidewall. The turbine airfoil has generally a plurality of film cooling holes through which the cooling air is blown out from the surface of the turbine airfoil, thereby cooling the turbine airfoil by heat absorption at the holes.

Significant quantities of holes are required to cool the turbine airfoil with heat absorption, but if the opening area of the holes is increased, the cooling air is likely to flow backwards at the holes. Therefore, conventionally, the opening area of the impingement holes is increased, and an appropriate pressure difference for the back flow is given. In this instance, however, there is a problem in that the flow rate of the cooling air is increased, so that engine performance deteriorates.

SUMMARY OF THE INVENTION

The invention has been made so as to solve the above-mentioned problem. That is, an object of the invention is to provide a cooling structure for a turbine airfoil capable of effectively cooling the turbine airfoil (in particular, the airfoil leading edge) and decreasing the cooling air flow rate as compared with a prior art.

According to the invention, there is provided a cooling structure of a turbine airfoil which cools a turbine airfoil exposed to hot gas using cooling air of a temperature lower than that of the hot gas, the turbine airfoil comprising an external surface exposed to the hot gas, an internal surface opposite to the external surface and cooled by the cooling air, a plurality of film-cooling holes extending between the internal surface and the external surface and blowing the cooling air from the internal surface toward the external surface to film-cool the external surface, and a plurality of heat-transfer promoting projections integrally formed with the internal surface and protruding inwardly from the internal surface, wherein a hollow cylindrical insert is set inside the internal surface of the turbine airfoil, the cooling air is supplied to an inside of the insert, and the insert has a plurality of impingement holes for impingement-cooling the internal surface.

According to a preferred embodiment of the invention, the heat-transfer promoting projection is formed in a cylindrical shape or in a cylindrical shape with rounded edge.

The film-cooling holes are arranged at a desired pitch P2 along a flow of the hot gas, the impingement holes are arranged at a desired pitch P1 along the flow of the hot gas so as to be positioned midway between the film-cooling holes which are adjacent to each other along the flow of the hot gas, and the heat-transfer promoting projections are arranged at positions which do not interfere with a flow path formed to cause flow from the impingement hole to the film-cooling hole adjacent to the impingement hole, at the desired pitch P3 along the flow of the hot gas.

In addition, the pitch P2 of the film-cooling holes is 1 to 2 times as large as the pitch P1 of the impingement holes, and the heat-transfer promoting projections have the pitch P3 equal to or smaller than half of the pitch P1 of the impingement holes, and are positioned at positions deviated from the impingement holes along the flow of the hot gas by at least half of the pitch.

With the configuration of the invention, the cooling air impinges against the internal surface of the turbine airfoil through the impingement holes of the insert to impingement-cool the internal surface of the turbine airfoil.

In addition, the cooling air is blown out from the film-cooling holes to the external surface of the turbine airfoil to cool the airfoil with the heat absorption and simultaneously film-cool the external surface.

Further, since the heat-transfer promoting projections are integrally formed with the internal surface of the turbine airfoil and protrude inwardly from the internal surface, the heat-transfer area of the internal surface (cooling sidewall) is increased, so that the number of the film holes necessary can be cut down.

Consequently, it is possible to effectively cool the turbine airfoil (in particular, the leading edge portion), and to cut the flow rate of the cooling air as compared with the prior art.

In addition, with the configuration in which the film-cooling holes are arranged at the desired pitch P2 along the flow of the hot gas, the impingement holes are arranged at the desired pitch P1 along the flow of the hot gas so as to be positioned midway between the film-cooling holes which are adjacent to each other along the flow of the hot gas, and the heat-transfer promoting projections are arranged at positions which do not interfere with the flow path formed to cause flow from the impingement hole to the film-cooling hole adjacent to the impingement hole, at the desired pitch P3 along the flow of the hot gas, it would be verified from a cooling performance test below that the heat-transfer area of the internal surface of the turbine airfoil can be increased and an increase in the pressure loss can be suppressed since the heat-transfer promoting projections do not interrupt the flow of the cooling air from the impingement hole to the film-cooling hole adjacent to the impingement hole.

DESCRIPTION OF THE PREFERRED EMBODIMENT

Figure 1A:
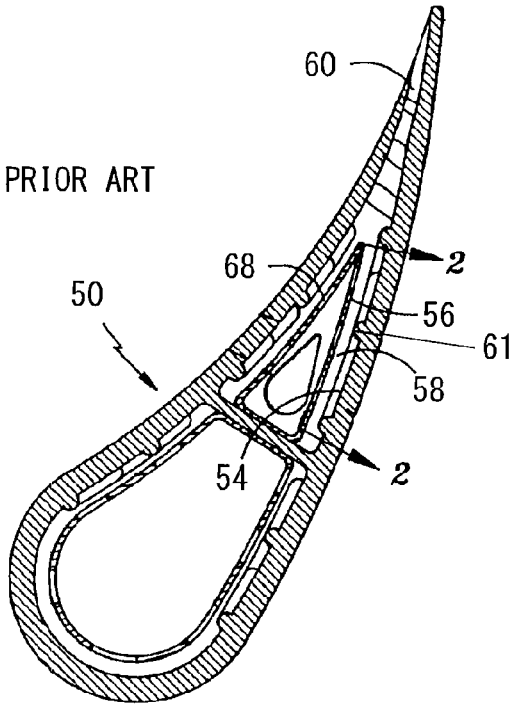
FIG. 1A PRIOR ART
FIG. 1A is an exemplary illustration of a gas turbine airfoil disclosed in Patent Document 1.
Figure 1B:
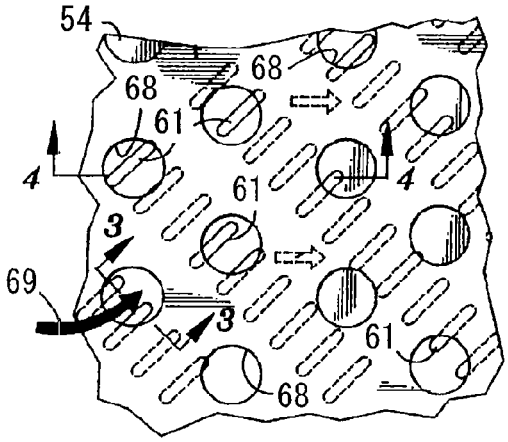
FIG. 1B PRIOR ART
FIG. 1B is another exemplary illustration of a gas turbine airfoil disclosed in Patent Document 1.
Figure 1C:
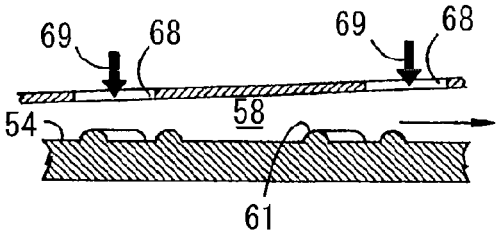
FIG. 1C PRIOR ART
FIG. 1C is another exemplary illustration of a gas turbine airfoil disclosed in Patent Document 1.
Figure 2A:
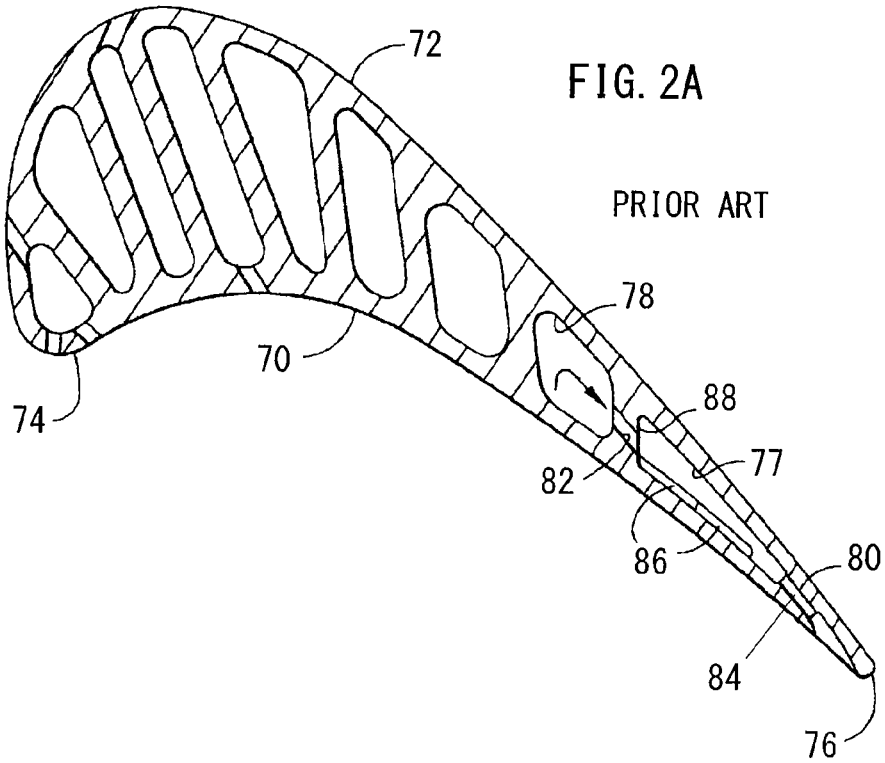
FIG. 2A PRIOR ART
FIG. 2A is an exemplary illustration of a gas turbine airfoil disclosed in Patent Document 2.
Figure 2B:
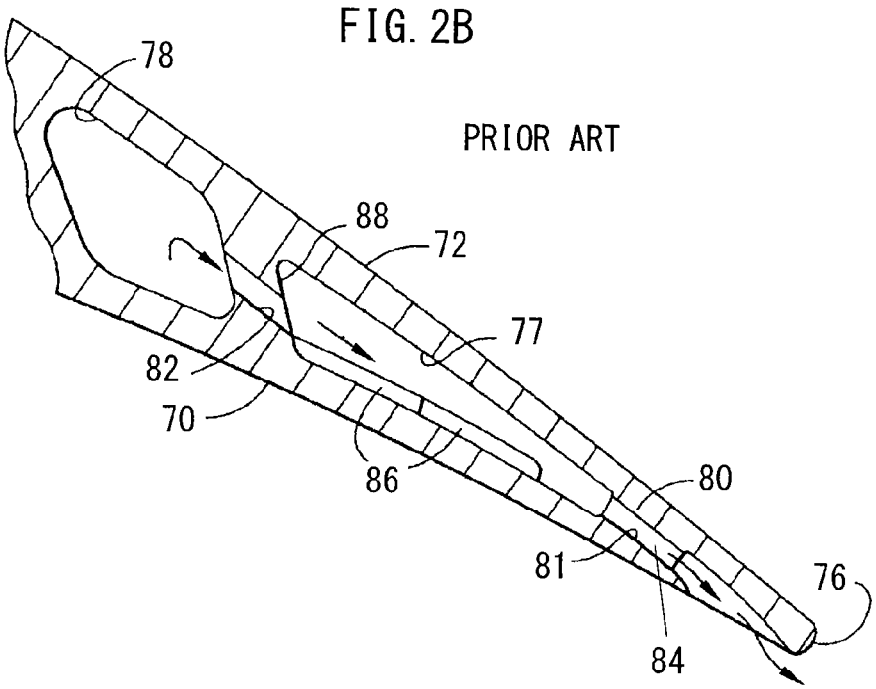
FIG. 2B PRIOR ART
FIG. 2B is an enlarged view of a trailing edge portion of a gas turbine airfoil disclosed in Patent Document 2.
Figure 3:
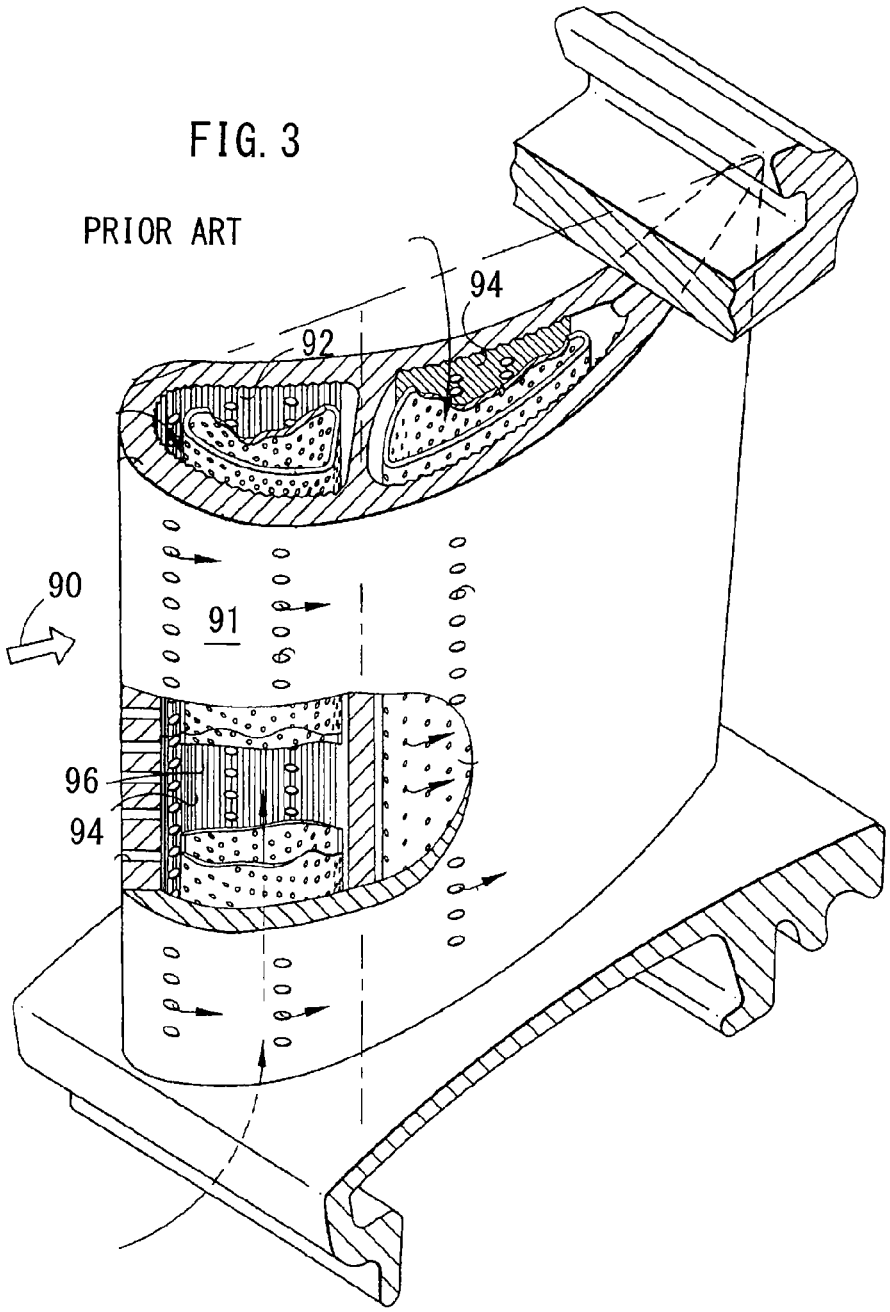
FIG. 3 PRIOR ART
FIG. 3 is an exemplary illustration of a gas turbine airfoil disclosed in Patent Document 3.

Next, a preferred embodiment of the invention will be described with reference to the accompanying drawings. Herein, the similar parts are denoted by the same reference numerals in each figure, and the repeated description will be omitted.

Figure 4:
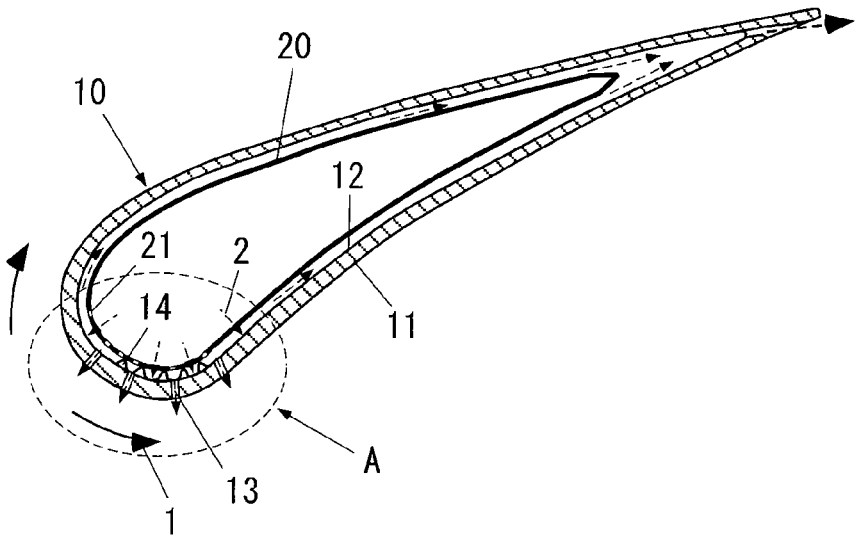
FIG. 4 is a cross-sectional view of a turbine airfoil having a cooling structure according to the invention.
Figure 5:
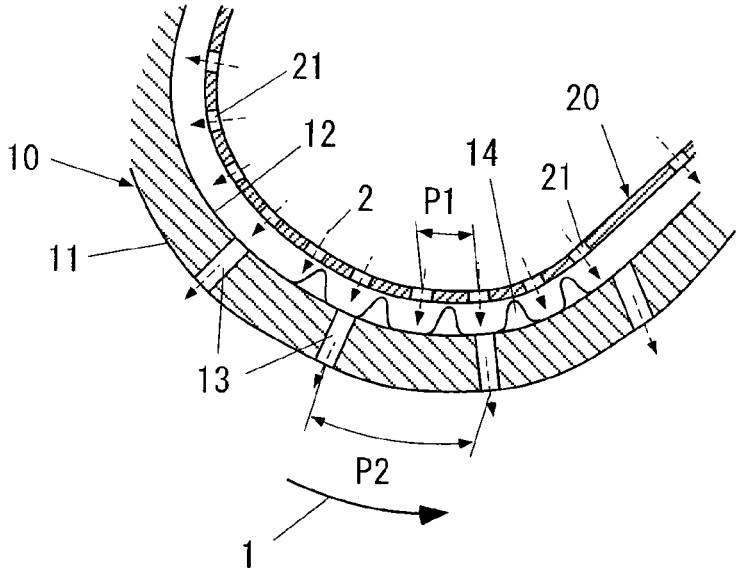
FIG. 5 is an enlarged view of the portion A in FIG. 4.

FIG. 4 is a cross-sectional view of a turbine airfoil having a cooling structure according to the invention. FIG. 5 is an enlarged view of the portion A in FIG. 4.

The cooling structure according to the invention is a cooling structure of the turbine airfoil which cools a turbine airfoil 10 exposed to hot gas 1, using cooling air 2 of a temperature lower than that of the hot gas 1.

As shown in FIGS. 4 and 5, the turbine airfoil 10 includes an external surface 11, an internal surface 12, a plurality of film-cooling holes 13, and a plurality of heat-transfer promoting projections 14.

The external surface 11 is exposed to the hot gas 1, and is heated by heat transfer from the hot gas 1.

The internal surface 12 is positioned opposite to the external surface 11, and is cooled by the cooling air 2 of temperature lower than the hot gas 1 supplied from an insert 20 (described below).

The plurality of film-cooling holes 13 extends between the internal surface 12 and the external surface 11, and blows the cooling air 2 from the internal surface 12 toward the external surface 11 to film-cool the external surface 11.

The plurality of heat-transfer promoting projections 14 is integrally formed with the internal surface 12, and increases the heat-transfer area of the inwardly protruding internal surface.

The cooling structure according to the invention includes a hollow cylindrical insert 20 set inside the internal surface 12 of the turbine airfoil 10. The cooling air 2 is supplied to an inside of the insert 20.

The insert 20 has a plurality of impingement holes 21 for impingement-cooling the internal surface 12 of the turbine airfoil 10. There is a clearance between the internal surface 12 of the turbine airfoil 10 and the external surface of the insert 20.

Figure 6A:
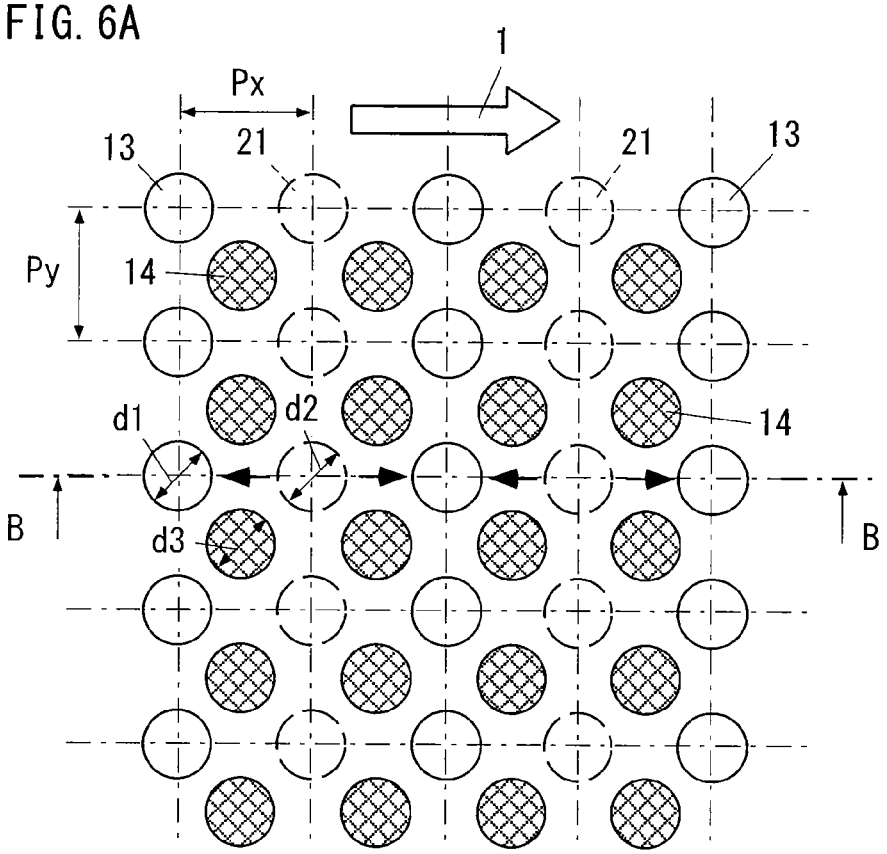
FIG. 6A is an exemplary illustration taken when seen from the inside of a turbine airfoil 10.
Figure 6B:
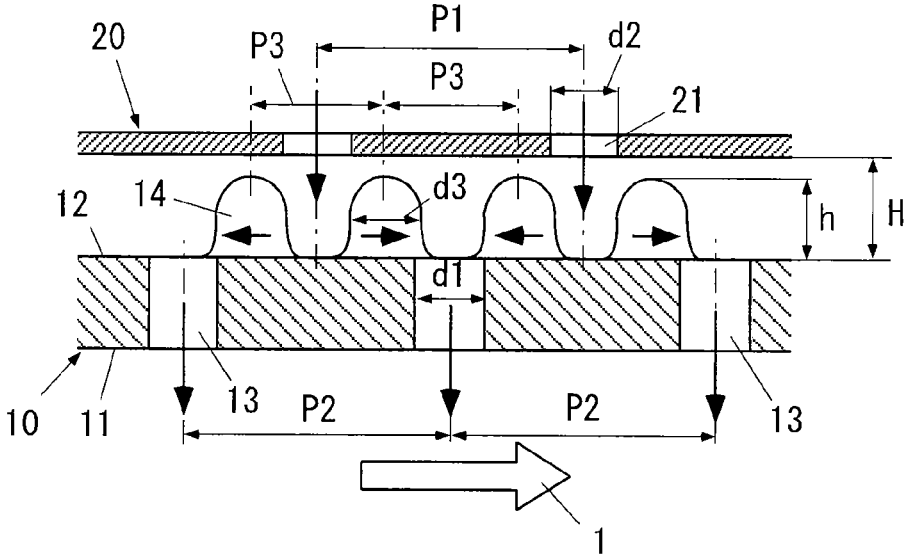
FIG. 6B is a cross-sectional view taken along the line B-B in FIG. 6A.

FIG. 6A is an exemplary illustration taken when seen from the inside of the turbine airfoil 10, in which the cooling structure according to the invention is spread out in a plane. FIG. 6B is a cross-sectional view taken along the line B-B in FIG. 6A.

In FIG. 6A, the film-cooling holes 13 and the impingement holes 21 are aligned along the flow of the hot gas 1. An interval between the film-cooling hole 13 and the impingement hole 21 in a flow direction of the hot gas 1 is set to Px in this embodiment.

Further, the film-cooling holes 13 and the impingement holes 21 are arranged in a pitch Py in a direction (in an upward and downward direction on the figure) perpendicular to the flow of the hot gas 1 on the same plane.

In addition, the heat-transfer promoting projections 14 are positioned at a position deviated from the film-cooling holes 13 and the impingement holes 21 in a direction (in an upward and downward direction on the figure) perpendicular to the flow of the hot gas 1 by the pitch of Py/2 in this embodiment.

In FIGS. 6A and 6B, the film-cooling holes 13 are openings having a diameter d1, and are arranged at a desired pitch P2 along the flow of the hot gas 1 on the external surface 11.

In this embodiment, the pitch P2 of the film-cooling holes 13 is twice as large as the interval Px between the film-cooling hole 13 and the impingement hole 21, and is identical to the pitch P1 of the impingement holes 21. In this instance, the invention is not limited thereto, and it is preferable that the pitch P2 of the film-cooling holes 13 is 1 to 2 times as large as the pitch P1 of the impingement holes 21.

Further, the impingement holes 21 are openings having a diameter d2, and are arranged at a desired pitch P1 along the flow of the hot gas 1 so as to be positioned in midway between the film-cooling holes 13 which are adjacent to each other along the flow of the hot gas 1 on the external surface 11. In this embodiment, the pitch P1 is twice as large as the interval Px, and is identical to the pitch P2 of the film-cooling holes 13.

In addition, the heat-transfer promoting projections 14 are arranged at positions which do not interfere with the flow path formed to cause flow from the impingement hole 21 to the film-cooling hole 13 adjacent to the impingement hole 21, at a desired pitch P3 along the flow of the hot gas 1. In this embodiment, the pitch P3 is identical to the pitch Px, and is equal to or smaller than half of the pitch P1 of the impingement holes 21.

Moreover, the heat-transfer promoting projections 14 are positioned at positions deviated from the impingement holes 21 along the flow of the hot gas by at least half of the pitch.

As shown in FIG. 6B, the heat-transfer promoting projection 14 is formed in a cylindrical shape having a diameter d3 and a height h or in a cylindrical shape with rounded edge. The height h is set to be equal to or slightly shorter than the spacing H between the internal surface 12 of the turbine airfoil 10 and the external surface of the insert 20.

In this instance, the shape of the heat-transfer promoting projection 14 is not limited to this embodiment. As far as the heat-transfer promoting projections 14 are integrally formed on the internal surface 12 and protrude inwardly from the internal surface, other shapes, for example, a conical shape, a pyramid shape, a plate shape or the like, may be employed.

EXAMPLE

In the configuration shown in FIGS. 6A and 6B, a cooling performance test was performed for the case of Px=10 mm, Py=10 mm, d1=4 mm, d2=4 mm, d3=4 mm, and h=H. In the cooling performance test, a test piece having the cooling structure was installed under combustion gas, and the cooling air was supplied into the test piece. The surface temperature was measured by an infrared camera and the flow rate of the cooling air was measured by a flowmeter.

Figure 7A:
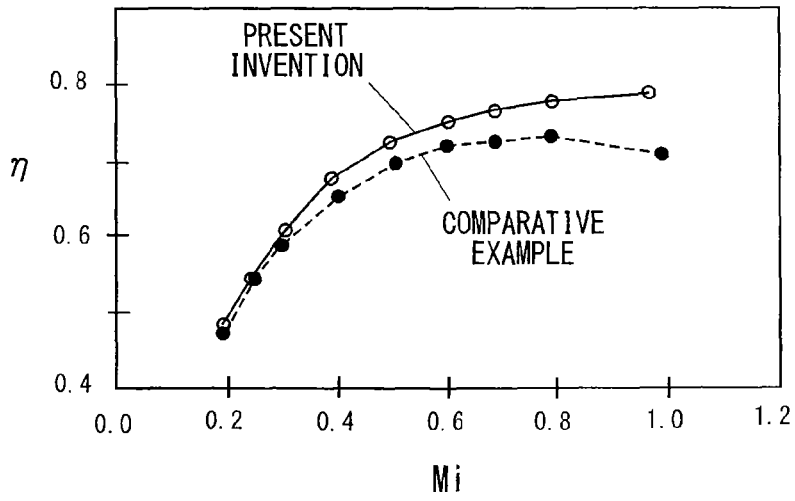
FIG. 7A shows cooling effectiveness of a test result.
Figure 7B:
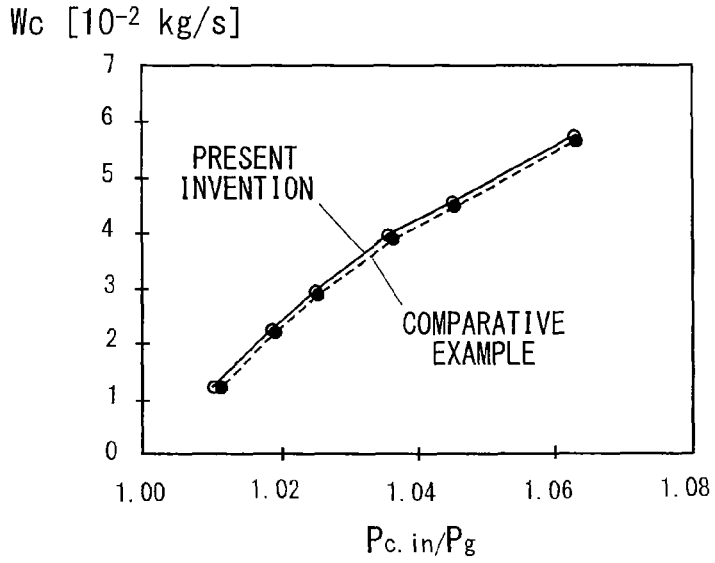
FIG. 7B shows a cooling air flow rate of a test result.

FIGS. 7A and 7B are views illustrating the test results, in which FIG. 7A is the cooling effectiveness and FIG. 7B is the cooling air flow rate.

In FIG. 7A, the horizontal axis refers to the ratio of mass flux Mi of cooling air to hot gas, and the vertical axis refers to cooling effectiveness. In the figure, a solid line indicates the present invention, and a dashed line indicates a comparative example with no heat-transfer promoting projection 14.

Further, in FIG. 7B, the horizontal axis refers to a pressure ratio Pc·in/Pg of cooling air to hot gas, and the vertical axis refers to a cooling air flow rate Wc($10^{-2}$ kg/s). In the figure, a solid line indicates the present invention, and a dashed line indicates a comparative example with no heat-transfer promoting projection 14.

It can be understood from the above results that although the cooling air flow rate is substantially equal to each other under the same pressure ratio, the cooling effectiveness is remarkably increased in the invention as compared with the comparative example without heat-transfer promoting projection 14. In addition, it can be understood that since the cooling air flow rate is not substantially varied under the same pressure ratio, pressure loss is not practically increased.

Consequently, in a case where the cooling effectiveness is the same, it is possible to remarkably decrease the necessary cooling air flow rate, to effectively cool the turbine airfoil (in particular, the leading edge portion) by the cooling structure according to the invention, and to reduce the cooling air flow rate as compared with the prior art.

As described above, with the configuration of the invention, the cooling air 2 impinges against the internal surface 12 of the turbine airfoil 10 through the impingement holes 21 of the insert 20 to impingement-cool the internal surface. In addition, the cooling air 2 is blown out from the film-cooling holes 13 to the external surface 11 of the turbine airfoil to cool the holes with the heat absorption and simultaneously film-cool the external surface.

Further, since the heat-transfer promoting projections 14 are integrally formed with the internal surface 12 of the turbine airfoil and protrude inwardly from the internal surface, the heat-transfer area of the internal surface 12 (cooling sidewall) is increased, so that the number of the film holes necessary can be cut down.

Consequently, it is possible to effectively cool the turbine airfoil 10 (in particular, the leading edge portion of the airfoil), and also it is possible to reduce the cooling air flow rate as compared with the prior art.

In addition, with the configuration in which the film-cooling holes 13 are arranged at the desired pitch P2 along the flow of the hot gas 1, the impingement holes 21 are arranged at the desired pitch P1 along the flow of the hot gas 1 so as to be positioned midway between the film-cooling holes 13 which are adjacent to each other along the flow of the hot gas 1, and the heat-transfer promoting projections 14 are arranged at positions which do not interfere with the flow path formed to cause flow from the impingement hole 21 to the film-cooling hole 13 adjacent to the impingement hole, at the desired pitch P3 along the flow of the hot gas 1, it would be verified from the above-described cooling performance test that the heat-transfer area of the internal surface 12 of the turbine airfoil 10 can be increased and an increase in the pressure loss can be suppressed.

In this instance, the invention is not limited to the embodiment described above. It is to be understood that the invention may be variously modified without departing from the spirit or scope of the invention.

For example, the configuration below may be provided different from the above-described example.

(1) The internal surface 12 with the heat-transfer promoting projections 14 is not limited to the leading edge portion of the turbine airfoil 10. In accordance with each design, it may be provided at other portions besides the leading edge portion.

(2) Although the shape of the heat-transfer promoting projection 14 is preferably cylindrical, due to manufacturing limitations, it may have an appropriate R (roundness) or the axial direction of the cylinder may not be perpendicular to the internal surface 12.

(3) In addition, although the cooling target is preferably the turbine airfoil, it is not limited thereto. It may be applied to cooling of a band or shroud surface.

The invention claimed is:

1. A cooling structure of a turbine airfoil which cools a turbine airfoil exposed to hot gas using cooling air of a temperature lower than that of the hot gas, the turbine airfoil comprising an external surface exposed to the hot gas, an internal surface opposite to the external surface and cooled by the cooling air, a plurality of film-cooling holes extending between the internal surface and the external surface and blowing the cooling air from the internal surface toward the external surface to film-cool the external surface, and a plurality of heat-transfer promoting projections integrally formed with the internal surface and protruding inwardly from the internal surface, wherein a hollow cylindrical insert is set inside the internal surface of the turbine airfoil, the cooling air is supplied to an inside of the insert, and the insert has a plurality of impingement holes for impingement-cooling the internal surface, wherein the plurality of heat-transfer promoting projections is set to be slightly shorter than a spacing between the internal surface of the turbine airfoil and the external surface of the insert, and wherein the heat-transfer promoting projections are formed in a cylindrical shape;

the film-cooling holes and the impingement holes are aligned to each other along the flow of the hot gas, the film-cooling holes are arranged at a pitch P2 along the flow of the hot gas, the impingement holes are arranged at a pitch P1 along the flow of the hot gas so as to be positioned midway between the film-cooling holes which are adjacent to each other along the flow of the hot gas; and the film-cooling holes and the impingement holes are arranged at a same pitch Py in a direction perpendicular to the flow of the hot gas, and the heat-transfer promoting projections are positioned at a position deviated from the film-cooling holes and the impingement holes in a direction perpendicular to the flow of the hot gas.

2. The cooling structure of the turbine airfoil as claimed in claim 1, wherein the heat-transfer promoting projections are formed in a cylindrical shape with rounded edge.

3. The cooling structure of the turbine airfoil as claimed in claim 1, wherein the heat-transfer promoting projections are arranged at positions which do not interfere with a flow path formed to cause flow from the impingement hole to the film-cooling hole adjacent to the impingement hole, at a desired pitch P3 along the flow of the hot gas.

4. The cooling structure of the turbine airfoil as claimed in claim 1, wherein the pitch P2 of the film-cooling holes is 1 to 2 times as large as the pitch P1 of the impingement holes, and the heat-transfer promoting projections have a pitch P3 equal to or smaller than half of the pitch P1 of the impingement holes, and the heat-transfer promoting projections are positioned at positions deviated from the impingement holes along the flow of the hot gas by half of the pitch P3.

5. The cooling structure of the turbine airfoil as claimed in claim 1, wherein the heat-transfer promoting projections are positioned at a position deviated from the film-cooling holes and the impingement holes at half of a pitch Py in a direction perpendicular to the flow of the hot gas, and further wherein the heat-transfer promoting projections are positioned at a position deviated from the film-cooling holes and the impingement holes at half of a pitch Px in a direction parallel to the flow of the hot gas.

* * * * *